US008136364B2

(12) United States Patent
Lifson et al.

(10) Patent No.: US 8,136,364 B2
(45) Date of Patent: Mar. 20, 2012

(54) REFRIGERANT SYSTEM WITH EXPANSION DEVICE BYPASS

(75) Inventors: Alexander Lifson, Manlius, NY (US); Michael F. Taras, Fayetteville, NY (US)

(73) Assignee: Carrier Corporation, Syracuse, NY (US)

( * ) Notice: Subject to any disclaimer, the term of this patent is extended or adjusted under 35 U.S.C. 154(b) by 541 days.

(21) Appl. No.: 12/307,604

(22) PCT Filed: Sep. 18, 2006

(86) PCT No.: PCT/US2006/036229

§ 371 (c)(1),
(2), (4) Date: Jan. 6, 2009

(87) PCT Pub. No.: WO2008/036079

PCT Pub. Date: Mar. 27, 2008

(65) Prior Publication Data

US 2009/0320506 A1 Dec. 31, 2009

(51) Int. Cl.
*F25B 41/06* (2006.01)

(52) U.S. Cl. ..... 62/197; 62/511; 62/513

(58) Field of Classification Search ..... 62/197, 62/511, 513

See application file for complete search history.

(56) References Cited

U.S. PATENT DOCUMENTS

| | | | | |
|---|---|---|---|---|
| 2,630,685 | A | 3/1953 | Lewis | |
| 3,839,879 | A | 10/1974 | Redfern et al. | |
| 4,439,996 | A * | 4/1984 | Frohbieter | 62/174 |
| 6,385,981 | B1 * | 5/2002 | Vaisman | 62/196.3 |
| 6,571,576 | B1 | 6/2003 | Lifson et al. | |
| 2005/0066674 | A1 | 3/2005 | Hirota et al. | |
| 2007/0074536 | A1 * | 4/2007 | Bai | 62/513 |
| 2007/0251256 | A1 * | 11/2007 | Pham et al. | 62/324.1 |

FOREIGN PATENT DOCUMENTS

JP 2005199772 11/2008

OTHER PUBLICATIONS

Ichekawa. JP 2005-199772 (English translation).*
Search Report and Written Opinion mailed Feb. 14, 2008 for PCT/US06/36229.
Notification of Trasmittal of International Preliminary Examination Report mailed on Oct. 24, 2008 for PCT/US06/36229.

* cited by examiner

*Primary Examiner* — Cheryl J Tyler
*Assistant Examiner* — Jonathan Bradford
(74) *Attorney, Agent, or Firm* — Carlson, Gaskey & Olds, PC

(57) ABSTRACT

A refrigerant system is provided with an expansion device that may be a thermostatic expansion device or an electronic expansion device. A bypass line selectively allows a portion of refrigerant to bypass the expansion device and to flow through a fixed restriction expansion device such as an orifice positioned in parallel configuration with the main expansion device. A valve selectively enables or blocks refrigerant flow through this bypass line depending on the volume of refrigerant required to circulate through the refrigerant system as defined by environmental conditions and a mode of operation. The valve can be a simple shutoff valve or a three-way valve selectively allowing or blocking refrigerant flow through a particular refrigerant line or lines. In one embodiment, the expansion device is the main expansion device for the refrigerant system. In the other embodiment, the expansion device is a vapor injection expansion device for expanding refrigerant for performing an economizer function. The present invention allows the use of a smaller expansion device, which can be more precisely controlled, while still allowing the accommodation of higher refrigerant mass flow when necessary.

19 Claims, 2 Drawing Sheets

REFRIGERANT SYSTEM WITH EXPANSION DEVICE BYPASS

BACKGROUND OF THE INVENTION

This application relates to a refrigerant system wherein a main expansion device such as a thermostatic or electronic expansion valve is provided with a bypass line having an auxiliary expansion device such as a fixed orifice, capillary tube or accurator. The bypass line is selectively closed or opened dependent upon the amount of refrigerant flowing through the refrigerant system such that the smaller main expansion device can be used to handle lower amounts of refrigerant typically circulating throughout the system at normal operating conditions, and the auxiliary expansion device positioned on the bypass line is only utilized when higher refrigerant flows need to be accommodated.

Refrigerant systems are known in the art, and typically circulate a refrigerant to condition a secondary fluid such as air. As an example, in a basic air conditioning system a compressor compresses a refrigerant and delivers it downstream to a first heat exchanger that, in the case of a cooling mode of operation, rejects heat to the ambient environment. The refrigerant passes from the first heat exchanger to an expansion device, and then through a second heat exchanger that, in the cooling mode of operation, cools a secondary fluid (e.g. air) to be delivered to a conditioned environment. From the second heat exchanger the refrigerant passes back to the compressor.

One known type of an expansion device is an expansion valve. In the expansion valve, a sensor (for an electronic expansion valve) or bulb (for a thermostatic expansion valve) is positioned at a specific location within the refrigerant system. This sensor communicates operating conditions such as a temperature, pressure, superheat or a combination of thereof back to the expansion valve. This feedback serves to adjust (open or close) a variable orifice through the expansion device such that a desired amount of refrigerant is allowed through the expansion device.

While expansion devices are widely utilized, there are some challenges associated with their applications. Such challenges include operation of these devices over a wide spectrum of indoor and outdoor environments as well as a need to handle transient conditions. In some applications, the amount of refrigerant circulating throughout the system can vary by two orders of magnitude depending on indoor and outdoor environments and transient system demands. For instance, the conditions requiring high mass flow of refrigerant to be circulated through the system may occur at a pull-down immediately after the startup, or when hot (and potentially humid) outdoor air is brought in to be conditioned or refrigerated to a desired temperature. On the other hand, part-load conditions at relatively cold ambient temperatures do not require high refrigerant system capacity, and the refrigerant mass flow rate must remain low.

Since, the expansion valve needs to be sized to handle all of the conditions, a relatively large valve would be required. This is unduly expensive and, in some cases, impractical. Moreover, when the refrigerant system is operating at more typical part-load conditions or at very low evaporator temperatures, the oversized expansion valve may not be able to precisely meter the refrigerant to achieve the desired performance characteristics at this part-load operation. Also, the larger size expansion device may not close completely, which can lead to refrigerant leakage at shutdown, or may take a longer time to close allowing more than desirable amount of refrigerant to migrate from high to lower pressure side of the system on a shutdown.

SUMMARY OF THE INVENTION

In a disclosed embodiment of this invention, a bypass is provided around a main expansion device. Although the disclosed expansion device is a thermostatic expansion device, the invention also extends to electronic expansion devices. The bypass includes a shutoff valve and a fixed orifice auxiliary expansion device. In high refrigerant volume flow situations, the bypass valve is opened and refrigerant can pass through both the thermostatic expansion device and through the fixed orifice expansion device. In this manner, very high volumes of refrigerant can still be expanded and precisely controlled as necessary. At the same time, the thermostatic expansion device itself can be downsized such that it can be finely tuned to achieve exact performance characteristics.

In various embodiments, the shutoff valve can be a three-way valve such that it can shut off either the refrigerant flow through the bypass line or the refrigerant flow through both the thermostatic expansion valve and the bypass line. Further, the expansion device and bypass assembly can be incorporated into an economizer cycle (positioned within an economizer branch) and provide similar benefits by controlling the refrigerant flow through the vapor injection line.

These and other features of the present invention can be best understood from the following specification and drawings, the following of which is a brief description.

DETAILED DESCRIPTION OF THE PREFERRED EMBODIMENTS

Figure 1:
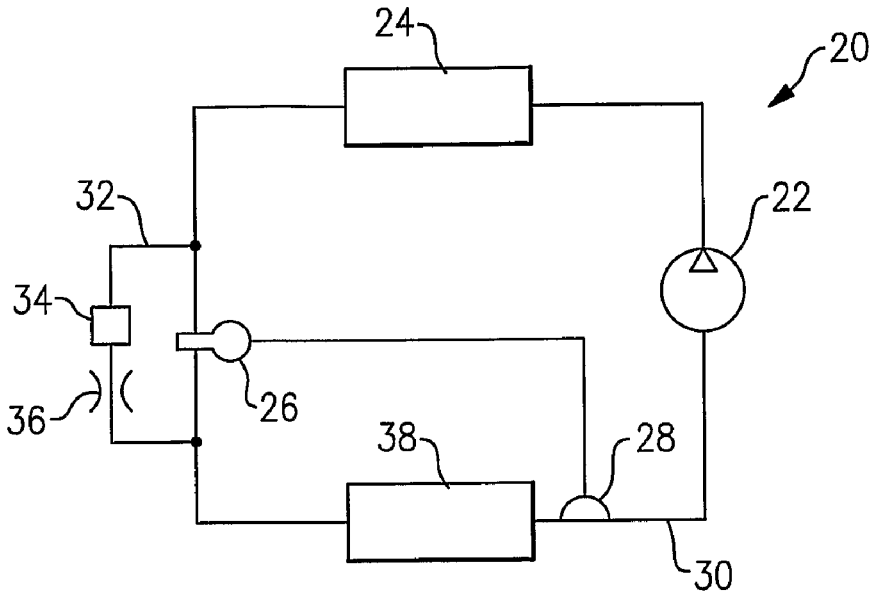
FIG. 1 shows a first schematic of the present invention.

A refrigerant system 20 is illustrated in FIG. 1 including a compressor 22 compressing a refrigerant and delivering it to a condenser 24. From the condenser 24 the refrigerant passes downstream through a thermostatic expansion valve 26 at which the refrigerant is expanded to a lower pressure and temperature. As is known, the degree of opening of the thermostatic expansion valve 26 is variable, and is controlled by a feedback from a bulb 28. The bulb controls the amount of opening of the thermostatic expansion valve 26 depending upon the temperature of the refrigerant sensed at the bulb 28 location, as well as operating pressure and internal valve construction, as known.

An evaporator 38 is positioned downstream of the thermostatic expansion valve 26. From the evaporator 38, refrigerant returns, through a suction line 30, to the compressor 22. As shown, the bulb 28 typically senses the temperature of the suction line 30, which is indicative of the temperature of the refrigerant flowing in the suction line.

The present invention is directed to the provision of a bypass line 32 around the thermostatic expansion valve 26, which serves as a main expansion device. In the FIG. 1 embodiment, a shutoff valve 34 either allows or blocks flow of refrigerant through the bypass line 32. When the shutoff valve 34 is open, at least a portion of refrigerant may pass through a fixed orifice 36, which serves as an auxiliary expansion device, and then to the evaporator 38. When relatively low refrigerant flow rates are required to be delivered throughout the refrigerant system, which is the case, for instance, at part-load conditions or at low evaporation temperatures, the valve 34 is closed by a system control (not shown). The thermostatic expansion valve 26 is sufficiently large to handle a wide spectrum of relatively low refrigerant flows. However, when higher refrigerant flows are required, which occurs for example at full-load conditions or during a pulldown, the valve 34 is opened. Now, at least a portion of refrigerant can flow through the bypass line 32 and the fixed orifice 36, and a combination of the fixed orifice 36 and the thermostatic expansion valve 26 can handle the higher refrigerant flows without "choking" and malfunctioning. The present invention thus allows the thermostatic expansion valve 26 to be downsized so that it can precisely meter the refrigerant at lower volume flow rates, but yet allow the overall refrigerant system 20 to properly operate at the higher volumetric refrigerant flows.

Figure 2:
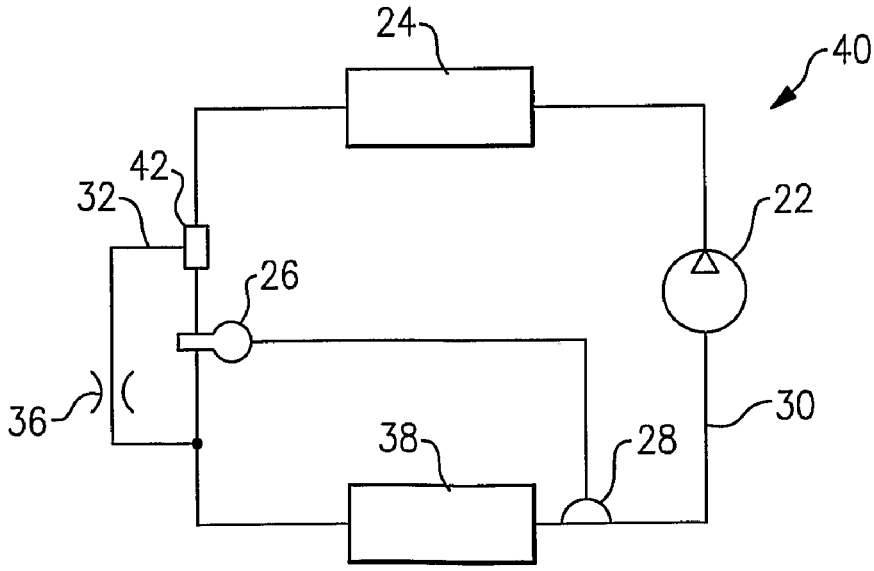
FIG. 2 shows a second schematic of the present invention.

FIG. 2 shows another embodiment 40, which includes many features similar to the FIG. 1 embodiment. The difference in the embodiment 40 is that the shutoff valve is replaced with a three-way valve 42. The three-way valve 42 can be, for example, of a solenoid valve type construction. This valve 42 will allow for refrigerant to flow through both the fixed orifice 36 and the thermostatic expansion valve 26 at high to intermediate flow volumes. At the lower flow conditions, the three-way valve 42 blocks flow through the bypass line 32, while still allowing flow through the expansion valve 26. When the refrigerant system 40 is shut off, the three-way valve 42 can be positioned such that it blocks the refrigerant flow through both the thermostatic expansion valve 26 and the bypass line 32. This prevents the migration of refrigerant from the condenser to the evaporator at off-cycle time intervals, which prevents some undesirable consequences to system reliability. Although the three-way valve 42 is positioned upstream of the expansion devices 26 and 36, it can be located downstream as well.

Figure 3:
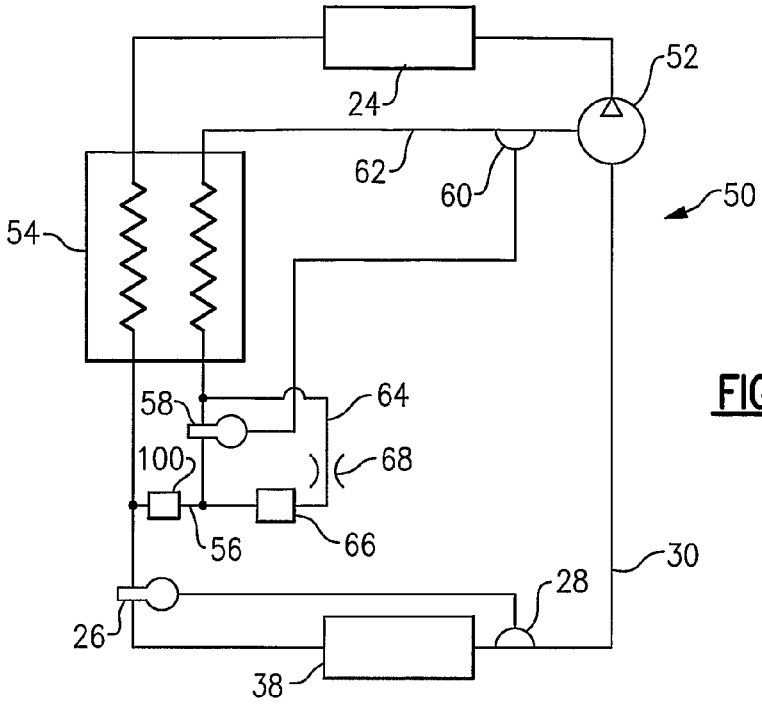
FIG. 3 show a third schematic of the present invention.

FIG. 3 shows yet another embodiment 50. In the embodiment 50, the compressor 52 is an economized compressor. The refrigerant passes from the compressor 52 through the condenser 24 and then through an economizer heat exchanger 54. The main expansion device is shown as a conventional thermostatic expansion valve 26 not having any bypass in this case. A tap line 56 taps a portion of refrigerant through an economizer thermostatic expansion valve 58. A bulb 60 of the economizer expansion valve 58 is positioned on a vapor injection line 62 returning the economized refrigerant flow (typically in a vapor state) to an intermediate compression point in the compressor 52. As is known, a portion of refrigerant is tapped through the line 56, and expanded in the expansion valve 58 to some intermediate (between suction and discharge) pressure and temperature. That expanded refrigerant in the economizer branch then passes in heat exchange relationship with the refrigerant in the main refrigerant circuit in the economizer heat exchanger 54. This provides additional subcooling to the main refrigerant and increases its cooling potential. Although the economized refrigerant is tapped downstream of the economizer heat exchanger 54, as known in the art, this tap junction point can also be located upstream of the economizer heat exchanger. In the FIG. 3 embodiment, the economizer thermostatic expansion valve 58 is also provided with a bypass line 64, a shutoff valve 66 and an auxiliary economizer expansion device such as a fixed orifice 68. As in previous embodiments, when higher volumes of refrigerant are to be moved through the economizer branch, the valve 66 is opened by a refrigerant system controller (not shown), and the economized refrigerant can pass through both the economizer thermostatic expansion valve 58 and the fixed orifice 68. On the other hand, when economized refrigerant flow requirements are low, the shutoff valve 66 is closed, since the economizer thermostatic expansion valve 58 alone can handle the reduced refrigerant flows. In this manner, the expansion of the refrigerant in the economizer branch can be precisely tailored as desired at reduced economized flow rates, while still maintaining higher refrigerant flow rates that may be necessary for other operating conditions.

Further, the economizer branch may be provided with a shutoff valve 100 to isolate it from an active refrigerant circuit, when extra capacity is not required. Once again, this shutoff device can be a three-way valve and incorporate the functionality of the shutoff valve 66. In the latter case, this three-way valve can completely isolate the economizer branch from the main refrigerant circuit when extra capacity is not required or just close the bypass line 64 at reduced economizer flows.

Figure 4:
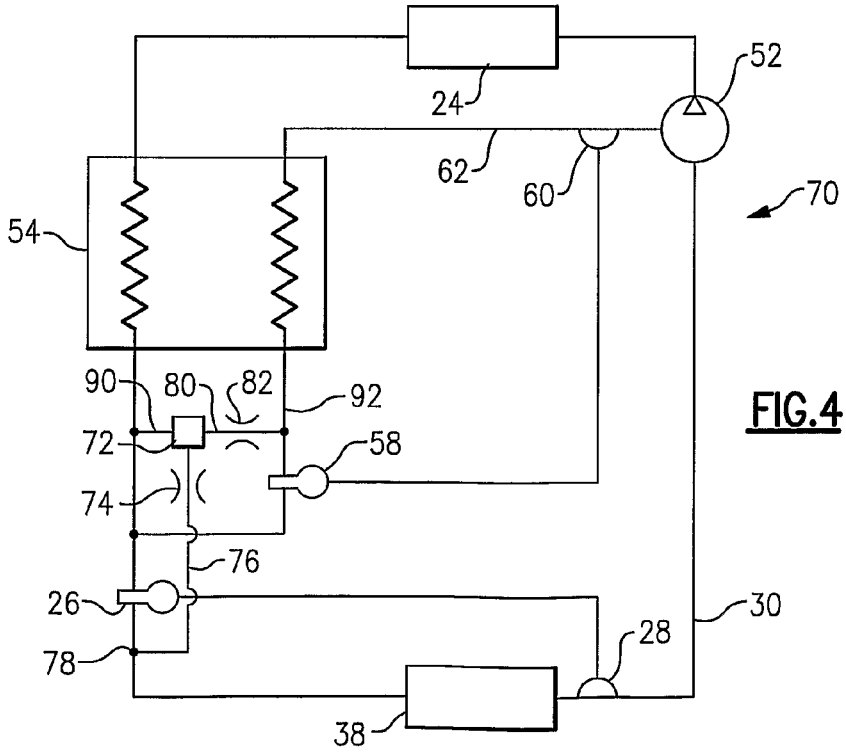
FIG. 4 shows a fourth schematic of the present invention.

FIG. 4 shows yet another embodiment 70. Again, the compressor 52 is an economized compressor and receives an economized refrigerant flow from the vapor injection line 62. The main thermostatic expansion valve 26 is provided with a bypass through a line 76, which passes through a fixed orifice 74 associated with the main thermostatic expansion valve 26. The economizer thermostatic expansion valve 58 is provided with a bypass through a line 80, which passes through a fixed orifice 82 associated with the economizer expansion valve 58. A three-way valve 72 allows the system to have a bypass around either the main thermostatic expansion valve 26 or the economizer thermostatic expansion valve 58. If the three-way valve 72 is positioned to communicate a line 90 to the line 76, it bypasses the thermostatic expansion valve 26, and passes at least a portion of the refrigerant through the fixed orifice 74 to achieve benefits such as disclosed with regard to FIGS. 1 and 2. On the other hand, if additional flow is desired through the economizer branch, then the three-way valve 72 is positioned to communicate the line 90 through the fixed orifice 82 to the line 92. The three-way valve 72 can also block flow through both bypass lines 76 and 92 at the reduced refrigerant flow rates or have both bypass lines open at the increased flow conditions.

As noted above, the refrigerant systems incorporating electronic expansion devices can equally benefit from this invention while a thermal bulb of the thermostatic expansion valve is typically replaced by a pair of sensors for an electronic expansion valve to measure (directly or indirectly) superheat of the refrigerant leaving an evaporator. In the case of the electronic expansion valve, there may be similar limitations on the size of this valve, as it is the case for the thermostatic expansion valve, as described above. Namely, to pass large amount of refrigerant it would require appropriately sized larger valves. Large electronic expansion valves are expensive, as well as have problems in effectively handling small refrigerant flow rates. Therefore, to overcome these problems, the electronic expansion valves also benefit from bypass arrangements disclosed above to appropriately handle large and small refrigerant rates as needed.

The present invention thus allows for handling of a wide spectrum of refrigerant flows passing through the expansion devices in a refrigerant system. The invention thus achieves the benefits of having a smaller main thermostatic expansion device with precise control at reduced refrigerant flow rates, while still allowing the handling of larger refrigerant flow volumes when necessary. Also, as known in the art, a three-way valve can be substituted by an appropriate combination of two-way valves. It would also fall within the scope of this invention, if the bypass line around a main expansion device had no isolation means. In other words, a small amount of refrigerant would be always allowed to pass through the bypass line. It would also fall within the scope of this invention, that when the expansion valve is in the shutdown position, there can be a small opening present in the valve to pass the refrigerant, or otherwise the valve can be completely shut down to completely block the refrigerant flow.

Although preferred embodiments of this invention have been disclosed, a worker of ordinary skill in the art would recognize that certain modifications would come within the scope of this invention. For that reason the following claims should be studied to determine the true scope and content of this invention.

We claim:

1. A refrigerant system comprising:

a compressor, said compressor compressing refrigerant and delivering it downstream to a first heat exchanger, refrigerant passing from said first heat exchanger through a first expansion device positioned downstream of the first heat exchanger, through a second heat exchanger positioned downstream of said first expansion device, and from said second heat exchanger back to said compressor; and a bypass line for selectively bypassing at least a portion of refrigerant around said first expansion device, said bypass line including an auxiliary expansion device to provide expansion of the refrigerant flowing through said bypass line, and an isolation member on said bypass line for selectively blocking flow of refrigerant to the auxiliary expansion device on said bypass line, said isolation member allowing selective flow of refrigerant through said bypass line from a point upstream of said first expansion device, and then back into a refrigerant flow line upstream of the connection to said second heat exchanger such that said bypass line and said first expansion device both deliver refrigerant to said second heat exchanger.

2. The refrigerant system as set forth in claim 1, wherein said isolation member is a shutoff valve.

3. The refrigerant system as set forth in claim 1, wherein said isolation member is a solenoid shutoff valve.

4. The refrigerant system as set forth in claim 1, wherein said isolation member is a three-way valve that can allow refrigerant flow to either said first expansion device, said bypass line and said first expansion device, or block refrigerant flow through both said expansion device and said bypass line.

5. The refrigerant system as set forth in claim 1, wherein said first expansion device is a main expansion device for the refrigerant system.

6. The refrigerant system as set forth in claim 5, wherein said first expansion device is a thermostatic expansion device having a bulb communicating with a point between said second heat exchanger and said compressor.

7. The refrigerant system as set forth in claim 5, wherein said first expansion device is an electronic expansion device.

8. The refrigerant system as set forth in claim 1, wherein said auxiliary expansion device is a fixed restriction expansion device.

9. The refrigerant system as set forth in claim 8, wherein said auxiliary expansion device is selected from a group consisting of an orifice, an accurator and a capillary tube.

10. The refrigerant system as set forth in claim 1, wherein said first expansion device is an economizer expansion device positioned on a tap line for tapping at least a portion of refrigerant from a main refrigerant circuit, expanding this refrigerant to an intermediate pressure, and passing said tapped refrigerant in heat transfer relationship with the main refrigerant flow through an economizer heat exchanger, the economizer heat exchanger being said second heat exchanger, and said bypass line around said economizer expansion device also communicating at least a portion of said tapped refrigerant into said economizer heat exchanger through and said auxiliary expansion device, said tapped refrigerant being returned to said compressor at an intermediate compression point.

11. The refrigerant system as set forth in claim 10, wherein said isolation member is a shutoff valve.

12. The refrigerant system as set forth in claim 10, wherein said isolation member is a solenoid shutoff valve.

13. The refrigerant system as set forth in claim 10, wherein said isolation member is a three-way valve that can allow refrigerant flow to either said economizer expansion device, said bypass line and said economizer expansion device, or block refrigerant flow through both said economizer expansion device and said bypass line.

14. The refrigerant system as set forth in claim 10, wherein said economizer expansion device is a thermostatic expansion device having a bulb communicating back to said thermostatic expansion device, said bulb being positioned on a vapor injection line for controlling return of the tapped refrigerant to said compressor.

15. The refrigerant system as set forth in claim 10, wherein said economizer expansion device is an electronic expansion device.

16. The refrigerant system as set forth in claim 10, wherein said auxiliary expansion device is a fixed restriction expansion device.

17. The refrigerant system as set forth in claim 16, wherein said auxiliary expansion device is selected from a group consisting of an orifice, an accurator and a capillary tube.

18. The refrigerant system as set forth in claim 10, wherein a main expansion device is also provided with a bypass, said bypass bypassing refrigerant selectively around said main expansion device, around said economizer expansion device and around both said main expansion device and said economizer expansion device.

19. The refrigerant system as set forth in claim 18, wherein a flow control device that allows for a refrigerant bypass around said main expansion device and said economizer expansion device can also selectively block the flow through the economizer expansion device or both said main expansion device and the economizer expansion device.

* * * * *